United States Patent [19]

Kasun et al.

[11] Patent Number: 4,480,936

[45] Date of Patent: Nov. 6, 1984

[54] TWO-PIECE TAPE/RIBBON CARTRIDGE

[75] Inventors: Michael J. Kasun, Stillwater; David C. Shaffer, Minneapolis, both of Minn.

[73] Assignee: K-Sun Corporation, Stillwater, Minn.

[21] Appl. No.: 460,247

[22] Filed: Jan. 24, 1983

[51] Int. Cl.[3] ..... B41J 35/28; B41J 15/00

[52] U.S. Cl. ..... 400/207; 400/613; 206/404; 242/55.3; 242/55.53

[58] Field of Search ..... 400/88, 134.5, 134.6, 400/207, 208, 208.1, 697, 697.1, 613, 615.2; 206/403, 404, 405; 242/55.2, 55.3, 55.53

[56] References Cited

U.S. PATENT DOCUMENTS

| | | | |
|---|---|---|---|
| 2,107,603 | 2/1938 | Ellenburg | 242/55.3 |
| 3,129,813 | 4/1964 | Norvelle | 242/55.53 |
| 3,834,507 | 9/1974 | Bradshaw | 400/134.6 |
| 3,912,064 | 10/1975 | Bluem et al. | 400/134.6 |
| 4,226,547 | 10/1980 | Bradshaw et al. | 400/613 |
| 4,243,333 | 1/1981 | Bradshaw et al. | 400/158 |
| 4,302,118 | 11/1981 | Schaefer | 400/208 |
| 4,360,278 | 11/1982 | Paque | 400/134.3 |
| 4,391,539 | 7/1983 | Connoy | 400/134.6 |
| 4,408,914 | 10/1983 | Ciesiel et al. | 400/208 |

FOREIGN PATENT DOCUMENTS 926588 5/1963 United Kingdom .

*Primary Examiner*—Edgar S. Burr
*Assistant Examiner*—David A. Wiecking
*Attorney, Agent, or Firm*—Orrin M. Haugen; Thomas J. Nikolai; Douglas L. Tschida

[57] ABSTRACT

A cartridge assembly for a printing machine of the type used to imprint alpha/numeric or other graphic information onto a continuous strip of tape using a carbon coated or otherwise colored ribbon. The cartridge assembly comprises two separate housings, one containing the spool or plastic tape and the other for containing the spool of carbon/ink coated ribbon and a means are provided for releasably coupling the two housings together such that as the tape and ribbon are drawn from their respective spools, they enter the print station of the machine in a face-to-face juxtaposed orientation.

9 Claims, 3 Drawing Figures

TWO-PIECE TAPE/RIBBON CARTRIDGE

BACKGROUND OF THE INVENTION

1. Field of the Invention

This invention relates generally to printing apparatus of the tape-ribbon variety, and more specifically to the design of a cartridge assembly for use in such apparatus in which the tape spool and the printing ribbon spool are contained in separate housings which can be releasably joined, one to the other, thus allowing ready substitution of one ribbon for another while continuing to use the same tape as the substrate upon which the printing is to be applied.

2. Discussion of the Prior Art

There is disclosed and described in the Bradshaw et al U.S. Pat. No. 4,243,333 a printing apparatus or composing system of the type involving the use of a pressure process to transfer dry carbon impressions onto an image carrying tape or medium. This apparatus includes a printing station in which a predetermined force may be applied to a font element which is positionable in alignment with the printing station and in which a tape and carbon coated ribbon may be advanced from a single cartridge and through the printing station. In the system of the aforereferenced Bradshaw et al patent, the carbon ribbon and the tape substrate on which the imprint is to be made are fed simultaneously from a single cartridge and through the printing station. The cartridge comprises a box-like enclosure in which a spool of tape and a spool of ribbon are rotatably mounted. The tape and ribbon exit from the housing and through an elongated tape guide portion which may be integrally joined to the housing. Further information relative to the design and construction of the prior art printing cartridge may be obtained from the Bradshaw et al U.S. Pat. No. 4,226,547.

SUMMARY OF THE INVENTION

The printing cartridge of the present invention is considered to be a significant improvement over the prior art, especially as represented by the printing cartridge described in the aforereferenced Bradshaw et al U.S. Pat. No. 4,226,547. Whereas, the Bradshaw printing cartridge encloses both the tape substrate and the carbon ribbon in a single housing, in the present invention the supply spools for the tape and the ribbon are individually contained in separate housings with provisions being made for releasably latching the two together when being inserted into the printing machine itself. As such, the same continuous tape substrate may be utitlized with the operator having the flexibility and option of changing carbon ribbons whereby the operator is afforded the freedom to change colors of the letters, numerals or other graphic information being printed.

In addition to the increased flexibility afforded by the present invention as suggested above, the design and constructional features of the cartridge are such that it can be manufactured at relatively low cost and, accordingly, can be competitively priced with other tape-ribbon cartridge products which do not incorporate the improved flexibility characteristics of the present invention. More specifically, the housing for the tape supply spool can be considered as a two-piece construction involving a front half and a back half, each preferably formed in a molding process from a suitable plastic with provision for fastening the two halves together to form a shell or enclosure for a rotatably mounted tape spool. Each of the "halves" has integrally formed therewith a guide member which serves to feed the tape from the spool to the printing station in a desired orientation. A flexible, deformable member is located in the guide means and intersects the path of travel of the tape to provide a preferred direction (outward) to the movement of the tape within the cartridge. The tape housing may also include a means for inhibiting the free rotation of the tape spool itself to prevent unwanted unraveling of the tape from its supply spool within the housing.

In a similar fashion, the ribbon housing may comprise a two-piece molded plastic construction with the two pieces including a means for joining them together to define a relatively closed compartment. Disposed within the compartment and extending across its width dimension is a post upon which a spool of carbon ribbon may be rotatably mounted. The carbon ribbon housing also has a guide member projecting outwardly therefrom which defines a path leading from the spool to the work station of the printing apparatus.

Formed on one side edge of the carbon ribbon housing is a flexible, deformable leaf spring element having a hook at one end thereof which is arranged to cooperate with a mating latch integrally formed on the tape housing. This arrangement permits the ribbon housing and tape housing to be releasably coupled together. When so-coupled, the guide member of the tape housing is held in a cooperating relationship with the corresponding guide member of the ribbon housing whereby the ribbon and tape, upon exiting the cartridge, are disposed in a flat, face-to-face relationship upon entry into the printing station.

Not only does the present invention provide the end user greater flexibility in terms of color choices and choices of the type of tape medium to be printed but also eases the inventory requirements for both the manufacturer and the dealer. Various tape mediums can be inventoried separate from various ribbon types. As such, a customer desiring a particular combination of tape and ribbon can be satisfied by appropriately selecting the two separate housings and snapping them together.

Accordingly, a principal object of the present invention is to provide an improved cartridge assembly for supplying tape and ribbon in a dry lettering system.

Another object of the present invention is to provide an improved tape-ribbon cartridge comprised of separate detachable housings, one for the tape supply and the other for the carbon ribbon supply.

A further object of the present invention is to provide a tape-ribbon cartridge for use in a dry lettering system which permits ready selection and matching of carbon ribbon types with tape types.

A yet further object of the invention is to provide a tape cartridge which is readily assembled and fabricated from low cost parts while still yielding excellent performance and high reliability.

These and other objects and advantages of the present invention will become apparent to those skilled in the art from a reading of the following description of the preferred embodiment and with reference to the drawings in which like numerals in the several views refer to corresponding parts.

DESCRIPTION OF THE PREFERRED EMBODIMENT

Figure 1:
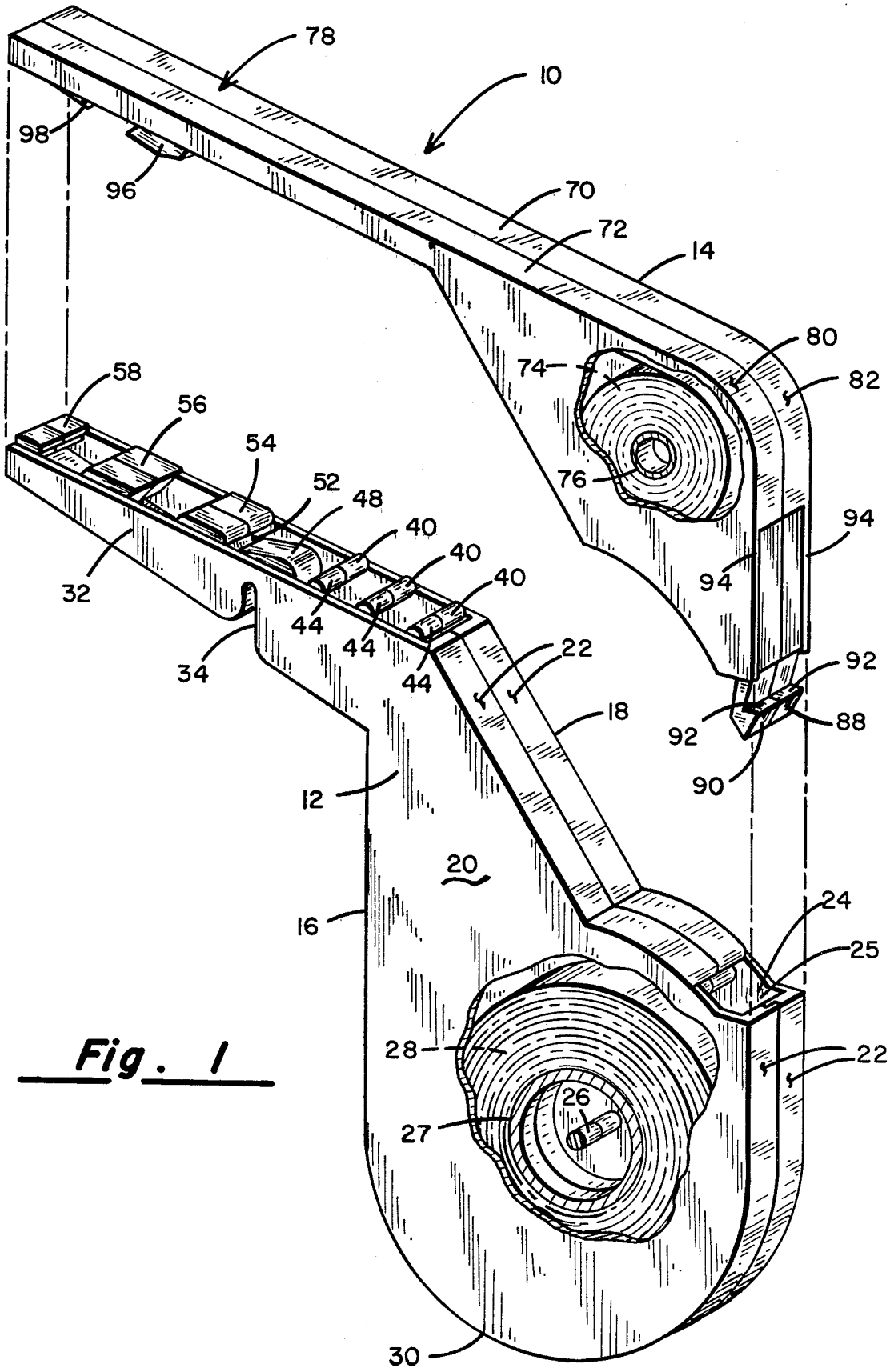
FIG. 1 is an exploded perspective view of the tape-ribbon cartridge in accordance with the present invention.

Referring to FIG. 1, it can be seen that the composite tape-ribbon cartridge is indicated generally by numeral 10 and includes a first housing member 12 and a second housing member 14 which members are designed to be releasably attached one to the other in a manner which will be set forth in greater detail below. The housing member 12 is comprised of a pair of generally bilaterally symmetrical parts which are preferably molded from high impact polystyrene or some other suitable plastic material. Each of the segments or halves 16 and 18 includes a side wall 20 and an edge wall 22 integrally formed with the side wall and projecting perpendicularly therefrom over substantially the entire periphery of the side walls. A small opening 24 is left in the edge wall 22 proximate the rear edge of the housing. The segments 16 and 18 are designed to snap together in a manner yet to be described such that their edge walls form a lap joint 25 along a median line or seam to create a generally closed container.

Projecting perpendicularly from the inner surface of the side wall of the molded plastic segment 18 is a cylindrical spindle 26 upon which a spool 27 of plastic tape 28 may be rotatably mounted. The tape is adapted to receive a printed image upon reaching the printing station of the machine in which the composite cartridge assembly of FIG. 1 is employed. In that the spool of tape is generally circular, it is found convenient to form the side walls and edge walls of the segments 16 and 18 with a generally concentric circular profile over a predetermined portion of their periphery as at 30, thus allowing an increase in the amount of tape which may be placed on the spool 28.

The first housing member 12 includes a guide means 32 comprising an elongated member integrally joined to each of the pair of molded plastic segments 16 and 18. These elongated members project outwardly from the edge wall 22 and, as will be described below, defines a tape travel path from the reel of tape 28 contained within the housing member 12 leading toward the printing station of the lettering machine in which the cartridge finds use. Formed in the undersurface of the guide means 32 is a notch 34 which is arranged to register with an edge of the cartridge holder portion of the printing machine with which the cartridge of the present invention finds use.

Figure 3:
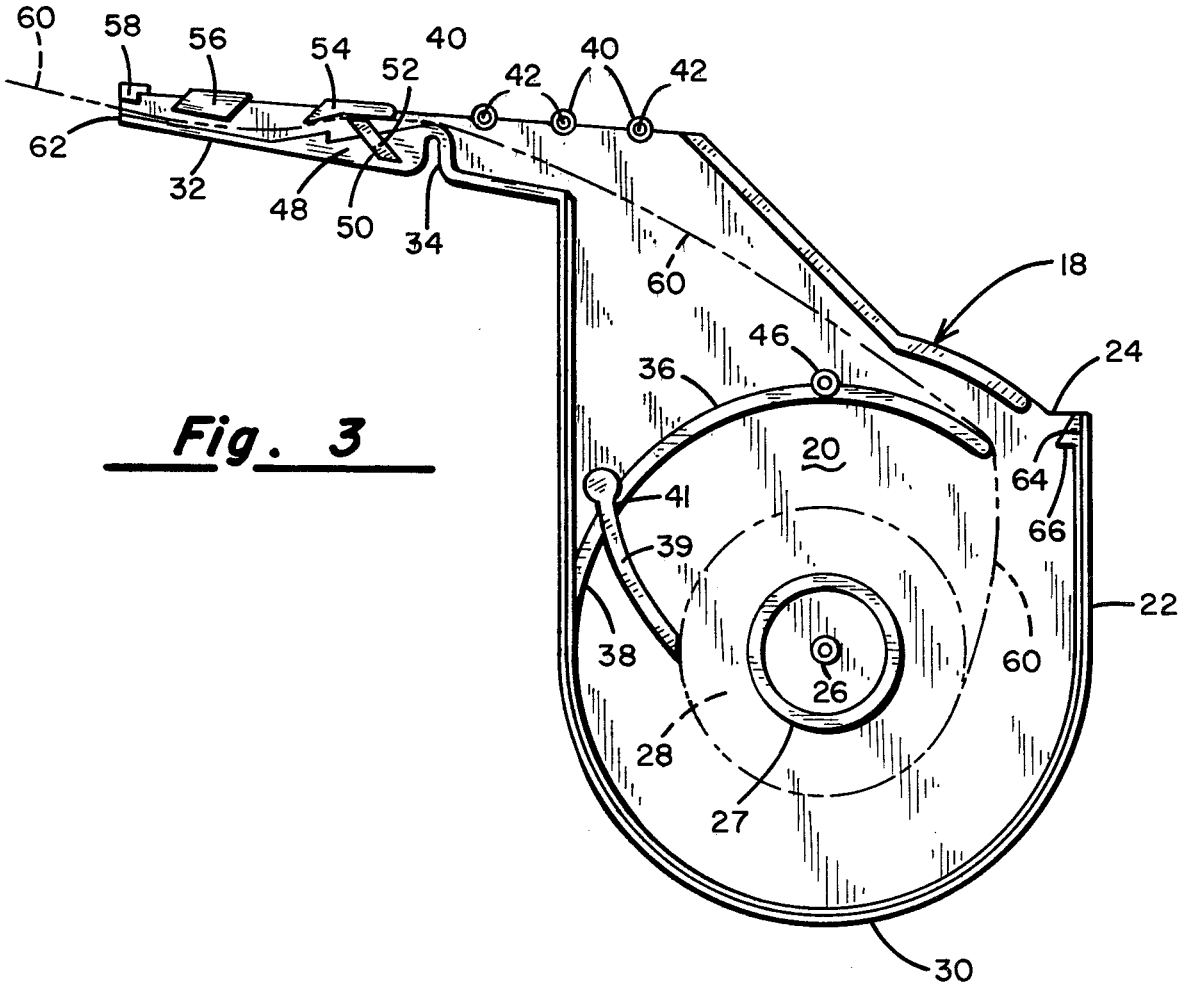
FIG. 3 is a side elevation of one-half of the tape housing.

Referring next to FIG. 3, the internal construction of the first housing member 12 can be perceived by viewing the segment 18. In that both housing halves 16 and 18 are practically identical, it was deemed unnecessary to show the interior construction of segment 16. Projecting inwardly from the inner surface of the side wall 20 is an arcuate surface 36 which joins to the edge wall 22 as at 38 and constitutes a continuation of the circularly curved portion 30 of the edge walls. Integrally molded along the upper edge of the guide member portion of the housing half 18 are a plurality of spaced apart cylindrical members 40 which extend approximately one-half the width of the housing. Projecting still further from the exposed ends of the cylinders 40 are concentric pins 42 which are of a length to be telescopingly received with a friction fit within corresponding cylindrical bores formed in the elements 44 integrally molded as a part of the other housing segment 16. In this fashion, the two halves of the housing snap together to define an enclosed chamber for the tape spool 28. To ensure a firm coupling between mating halves of the housing, further pin and socket members as at 46 may be provided.

With continued reference to FIG. 3, guide member 32 includes a solid, integrally molded wedge 48 having a notch 50 formed at an angle or slant therein for receiving a soft, flexible, pliant insert 52. The insert 52 may be formed from a soft rubber, a plastic or even fabric material and it functions as a friction break for tape exiting the first housing, all as will be explained in greater detail below. Also integrally molded with the housing segments 16 and 18 are inwardly projecting surfaces 54, 56 and 58. These projections function as spacers for adding stiffness or rigidity to the guide member 32 when the two halves of the housing are snapped together.

The broken line 60 indicates the path of travel of the plastic tape upon leaving the rotatable spool 27. It first passes over the end edge of the arcuate surface 36 and then over the rounded leading edge of the molded wedge shaped projection 48 and between the upper end of the flexible break member 52 and the cooperating surface of the molded projection 54 and thence beneath the molded projections 56 and 58 and out the open end 62 of the guide means. It may also be desirable to include a friction-increasing means in conjunction with the spool of tape 28 to prevent it from freely spinning within the housing and creating a slack loop tape condition within the housing. This friction increasing means may comprise a flexible metal, plastic or rubber wiper 39 connected to the interior of the housing such as by fitting into a slot 41 formed in the arcuate surface 36, and arranged to cooperate by pressing against the periphery of the tape reel. Alternatively, it may comprise a bent-washer or compression spring arrangement mounted upon the spindle 26 for cooperating with a side surface of the spool of tape.

Also shown in FIG. 3 just within the opening 24 is a latch means 64 having a tapered surface terminating in a shoulder zone 66. This latch means may also be integrally molded with the cartridge halves and when the two are joined, the shoulder 66 extends substantially all the way across the width of the cartridge beneath the opening 24.

Figure 2:
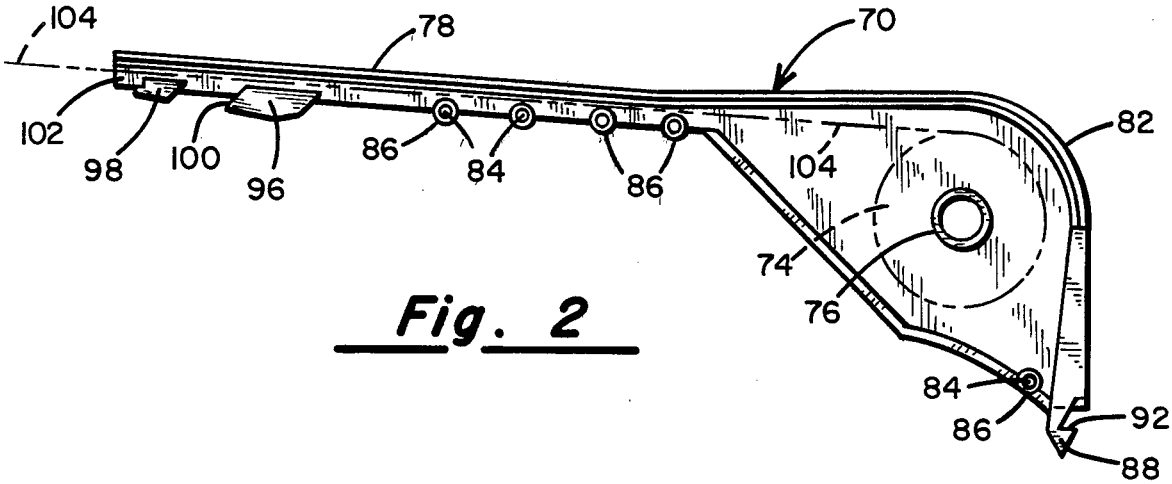
FIG. 2 is a side elevation of one-half of the printing ribbon housing.

Referring next to FIGS. 1 and 2, it can be seen that the second housing member 14, while of a different shape, is fabricated using construction techniques similar to that for the first housing member 12. That is to say, it comprises a pair of molded plastic parts 70 and 72 which snap together in a side-by-side relationship so as to define an enclosure for a spool 74 of printing ribbon which is rotatably mounted on a post or spindle 76 integrally formed with and projecting inwardly from one of the side walls of the molded plastic parts 70 or 72. Like the first housing member 16, the second housing member 14 also includes a guide means 78 in the form of an elongated member integrally joined to each pair of molded plastic housing parts 70 and 72 and constituting an extension of the inwardly extending edge walls 80 and 82 thereof. The two halves of the ribbon housing 14 are coupled together in a fashion similar to that used in joining the two halves of the tape housing 12. That is to say, the parts are molded so as to create a lap joint along their mating edges and pins, such as at 84, are molded so as to project from the end surface of cylindrical spacer members 86 with those pins cooperating with corresponding bores (not shown) formed in cylindrical projections molded as a part of the housing half.

The ribbon housing 14 further includes a means for releasably attaching it to the tape housing member 12. Specifically, integrally molded with the side edges 80 and 82 proximate the lower end thereof are hook members 88 and 90 which define shoulder surfaces 92 adapted to cooperate with the shoulder surface 66 of the tape housing 12. The edge surfaces 80 and 82 are slit as at 94 for a predetermined distance so as to separate these edge surfaces from the mating side surfaces of the cartridge housing. As such, the edge surfaces function as leaf-type springs in that the plastic material from which the parts are fabricated provide a degree of resiliency.

With further reference to FIG. 2, molded as a part of the guide member 78 on the undersurface thereof are solid, plastic spacer members 96 and 98. The spacer member 96 has a slanted front edge 100 while the spacer member 98 includes a L-shaped notch 102 on its front edge. The relative spacing of the spacers 96 and 98 and the positioning of the coupling members 86 are such that they mesh with the spacer members 54, 56 and 58 of the housing member 12 and the pin and socket couplings of the housing 12 fall between those of the housing 14 when the housing 14 is superimposed atop the housing 12. More specifically, it can be seen that the L-shaped notch 102 may be fitted beneath the corresponding notch formed on the spacer members 58 and, when this is done, the sloped leading edge 100 of the spacer member 96 will abut the correspondingly sloped trailing edges of the spacer member 56. Then, when the ribbon housing 14 is squeezed against the tape housing 12, the surfaces 88 and 90 will slide downward along the slope surface of latch 64 until the hook elements lock with the latch.

In FIG. 2 the broken line 104 depicts the path assumed by the carbon ribbon 74. When the ribbon housing is latched to the tape housing, the tape and ribbon will exit the composite cartridge in face-to-face registration. That is, a first flat face of the tape will be juxtaposed with a first flat face of the ribbon in moving from the cartridge to the printing station of the machine in which the cartridge is used.

While not shown in the drawings, it may be desirable to also provide a brake arrangement for the spool 74 of printing ribbon. This brake would be made to cooperate with the spool in such a fashion that a certain amount of tension must be applied to the printing ribbon in order to withdraw it from the spool. As such, the spool is restrained from freely rotating and building up a slack loop within the housing 14.

While in most instances, the telescoping pin and bore arrangement can be used to firmly join the molded plastic housing parts or segments together, it is also possible to more firmly bond the mating halves together through thermal, chemical or ultrasonic bonding techniques, all of which are well known in the art.

By providing means for releasably joining the tape housing 16 to the ribbon housing 14, it is possible to easily substitute different ribbons, thus, for example, facilitating the use of multi-colored printing techniques without having a repeatedly cut and adhesively affix the printed plastic tape to the graphics work being created. That is to say, multi-colored lettering can be impressed upon a continuous strip of tape emanating from the spool 28.

Furthermore, it is possible to mix and match ribbon types with tape mediums in a fashion which decreases the overall inventory requirements of the manufacturer and/or dealer. Assuming there are ten ribbon color selections and four types of tape mediums, it is not necessary to maintain an inventory of forty different cartridges as is required using prior art cartridge designs. Instead, an inventory of only fourteen housings is needed to accommodate all customers.

The invention has been described herein in consideration detail, in order to comply with the Patent Statutes and to provide those skilled in the art with the information needed to apply the novel principles, and to construct and use such specialized components as are required. However, it is to be understood that the invention can be carried out by specifically different equipment and devices, and that various modifications, both as to equipment details and operating procedures, can be effected without departing from the scope of the invention itself.

We claim:

1. A printing cartridge assembly for use in a lettering machine having a printing station, said printing cartridge assembly containing a tape supply and a printing ribbon supply, said lettering machine causing said ribbon supply to print upon said tape supply, said printing cartridge, comprising:

(a) a first housing member;

(b) a spool of said tape rotatably mounted within and generally enclosed by said first housing member;

(c) a second housing member;

(d) a spool of said printing ribbon rotatably mounted within and generally enclosed by said second housing member;

(e) guide means projecting outwardly from both said first and second housing members; and (f) means to enable said ribbon supply to be replaced by a ribbon supply of a different color, said last mentioned means including means for releasably attaching said first housing member to said second housing member so that said second housing member can be replaced with a new second housing member containing a ribbon of a different color, the guide means associated with said first and second housing members orienting said tape and ribbon exiting from said first and second housing members in a face-to-face relationship so that upon entry into said print station of said lettering machine said ribbon can be used to print upon said tape.

2. The printing cartridge assembly as in claim 1 wherein said first housing member comprises:

(a) a pair of generally bilaterally symmetrical molded plastic segments, each having a side wall and an edge wall extending perpendicularly from said side wall about at least a portion of the periphery of said side wall; and (b) means for joining the edge walls of said pair of segments together along a midline to define a generally closed container.

3. The printing cartridge assembly as in claim 2 and further including a cylindrical projection extending perpendicularly from one of said side walls upon which said spool of tape is rotatably mounted.

4. The printing cartridge as in claim 3 wherein the side walls and edge walls of said pair of segments are generally circularly curved over a predetermined portion of their periphery, with the center of said circularly curved portion being at the point at which said cylindrical projection extends from one of said side walls.

5. The printing cartridge assembly as in claim 4 and further including an arcuate surface joined to at least one of said side walls of said pair of molded plastic segments and extending normally from said side wall in the same direction as said edge walls with said arcuate surface forming a continuation of said circularly curved portion of said edge walls.

6. The printing cartridge as in claim 2 wherein said guide means associated with said first housing member comprises:

(b) an elongated member integrally joined to each of said pair of molded plastic segments and projecting outwardly from said edge wall to define a tape travel path from said first housing member toward said printing station of said lettering machine.

7. The printing cartridge as in claim 1 wherein said second housing member comprises:

(a) a pair of molded plastic parts, each having a side wall and an edge wall extending normally from said side wall along a predetermined portion of the periphery of said edge wall;

(b) means for joining the edge walls of said molded plastic parts together along a midline to define a generally closed container for said spool of printing ribbon.

8. The printing cartridge as in claim 7 wherein said guide means associated with said second housing member comprises an elongated member integrally joined to each of said pair of molded plastic parts and forming an extension of said edge walls of said second housing member to define a printing ribbon travel path from said second housing member towards said printing station of said lettering machine.

9. The printing cartridge as in claim 2 wherein said means for releasably attaching said first housing member to said second housing member comprises:

(a) latch means integrally formed on at least one of said edge walls of said first housing member at a predetermined location thereon; and (b) resilient hook means integrally formed on said second housing member for engaging said latch means.

* * * * *

UNITED STATES PATENT AND TRADEMARK OFFICE

CERTIFICATE OF CORRECTION

PATENT NO. : 4,480,936

DATED : November 6, 1984

INVENTOR(S) : Michael J. Kasun

It is certified that error appears in the above-identified patent and that said Letters Patent are hereby corrected as shown below:

Column 7, Line 17, "(b)" should read -- (a) --.

Signed and Sealed this

*Nineteenth* Day of *March 1985*

[SEAL]

*Attest:*

DONALD J. QUIGG

*Attesting Officer*

*Acting Commissioner of Patents and Trademarks*